US005902401A

United States Patent [19]

Elvidge et al.

[11] Patent Number: 5,902,401

[45] Date of Patent: May 11, 1999

[54] COATER HEAD

[75] Inventors: David Richard Elvidge, North Vancouver; Olivier Reglat, Montreal; Malcolm Kenneth Smith, North Vancouver; Philippe Andre Tanguy, Montreal, all of Canada

[73] Assignee: Pevifibe Papers Inc., Vancouver, Canada

[21] Appl. No.: 08/890,409

[22] Filed: Jul. 9, 1997

[51] Int. Cl.[6] ..... B05C 1/06

[52] U.S. Cl. ..... 118/262; 118/414

[58] Field of Search ..... 118/410, 411, 118/419, 261, 262, 414, 249, 117, 119

[56] References Cited

U.S. PATENT DOCUMENTS 4,396,684 8/1983 Holt et al. .
4,405,661 9/1983 Alheid .
4,688,516 8/1987 Somer .
4,780,336 10/1988 Damrau .
4,839,201 6/1989 Rantanen et al. .
4,945,855 8/1990 Eklund et al. .
5,078,081 1/1992 Kustermann .
5,192,591 3/1993 Chance ..... 118/410
5,397,601 3/1995 Korhonen ..... 118/414

*Primary Examiner*—Brenda A. Lamb
*Attorney, Agent, or Firm*—C. A. Rowley

[57] ABSTRACT

A coater head for applying coating to a size press roll of a size press coater, the coater head has a flow passage with a metering device at its outlet end and a metering chamber immediately adjacent to the metering end. A shear developing passage delivers coating to the metering chamber and a mixing passage leading into the metering chamber mixes fresh coating with return coating on the surface of the roll to carry the fresh coating to the outlet end of the metering chamber. The metering chamber is dimensioned to form a stable vortex within the chamber thereby to improve the uniformity of the coating wet film.

19 Claims, 3 Drawing Sheets

COATER HEAD

FIELD OF INVENTION

The present invention relates to a coater head, more particularly, the present invention relates to an improved coater head for metering size press application of coatings.

BACKGROUND OF THE INVENTION

Size press coating of paper substrates generally involves the application of a coating via a coater head onto the surface of the size press application roll and then transferring the coating from the size press application roll surface to the paper web or the like in a size press application nip. The paper web does not pick up all of the coating available in the application nip of the size press and thus, some of the coating is carried on the application roll surface back to the coater head where it is mixed with and picks up fresh coating delivered to the head and carries same through a metering nip formed at the outlet end of the coater head.

To facilitate uniform pick-up, it is essential that the wet film of coating on the roll surface between the coater head and the application nip of the size press be relatively uniform, hence, the use of some form of metering device generally a smooth metering rod at the outlet end of the coater head is used to form a metering nip with the size press roll. This rod is intended to ensure that the wet film on the roll between the metering nip and the application nip is as uniform as possible and to meter the amount of coating in the wet film of the roll, i.e. the thickness of the wet film measured from the roll surface.

The speed of the equipment (peripheral speed of the size press rolls) is relatively fast, generally over a thousand meters a minute. Thus, the hydrodynamic conditions generated in the coater head influences the ability of the metering rod to properly meter the coating. Another significant factor is the properties of the coating fluid as it approaches the metering nip.

Many different coater head designs have been suggested. However, the problems associated with the hydraulic conditions generated and the properties of the coating fluid particularly at the metering nip have persisted.

U.S. Pat. Nos. 4,396,648 issued Aug. 2, 1983 to Holt et al. (Consolidated Papers Inc), 4,405,661 issued Sep. 20, 1983 to Alheid (Beloit Corporation), 4,688,516 issued Aug. 25, 1987 to Sommer (Jagenberg A G), 4,839,201 issued Jun. 13, 1989 to Rantanen et al. (Valmet Paper Machinery Inc) and 4,945,855 issued Aug. 7, 1990 to Eklund et al. (Valmet Paper Machinery Inc) illustrate various different types of coater heads for application of coatings either directly to the paper or onto a size press roll for application in a size press applicator.

It is apparent that the flow passage geometries in these devices are all quite different but all generally have in common (with the exception of U.S. Pat. No. 4,945,855), a fluid delivery system that delivers the coating fluid to a chamber immediately preceding the metering device and simply permits the fluid to flow through the metering device in the direction of movement of the surface to which the coating is being applied. No particular precautions are taken or instructions given with respect to generating stable conditions in the coating fluid approaching the metering nip i.e. controlling the hydraulic conditions to avoid undue metering problems at the metering nip nor is any reference made to or teachings provided for adjusting the rheology of the coating to present a coating with the desired properties to the metering nip to facilitate its application.

U.S. Pat. No. 4,945,855 uses a different technique in that the fluid is applied before a first metering device and then flows past the first metering device to the final metering device and a return flow passage is provided from adjacent final metering device for its recirculation or removal of excess coating. As with the other devices, no accommodation is made to control vortexes that are formed upstream of the metering device.

U.S. Pat. No. 4,780,336 issued Oct. 25, 1988 to Damrau (Consolidated Papers Inc) does discuss the formation of turbulence and flow patterns in a high speed machine immediately upstream of the metering device (in this case a metering blade). This patent deems the added turbulence generated upstream of the metering nip to be uncontrollable i.e. the hydraulic conditions in the coating fluid approaching the metering nip are uncontrollable and teaches reinforcing the metering blade to reduce flexure caused by these uncontrolled conditions to a minimum and thereby improve the uniformity of the coating in spite of the uncontrollable turbulence.

U.S. Pat. No. 5,078,081 issued Jan. 7, 1992 to Kustermann (J. M. Voith gmbH) discloses a coating applicator head having a throttle gap leading into or toward the metering nip of the applicator and a second throttling channel upstream of the throttle leading to the metering end of the flow chamber, the second throttling channel permitting escape of excess coating fluid being delivered to the metering device. Apparently, the two throttles co-operate to adjust the flow to the metering end of the flow passage.

BRIEF DESCRIPTION OF THE PRESENT INVENTION

It is an object of the present invention to provide a coater head for application of high solids content coating formulations (with high viscosity) at high speeds and low coat weights.

It is a further object of the present invention to provide a coater head which reduces significantly the generation of instabilities in the flow of coating from upstream of the metering end of the coater head.

It is yet another object of the present invention to provide a metering head which permits reduction of coating fluid pumping rate by reducing the amount of recirculated coating fluid for application of a given coat weight.

It is a further object of the present invention to provide a coater head wherein coating fluid theological properties may be adjusted to facilitate their application at low coat weights.

Broadly, the present invention relates to a coater head for application of a coating to a receiving surface on a size press roll of a size press type coater, said roll rotating relative to said coater head to move said surface past said coater head, said coater head comprising a flow passage, a metering means at an outlet end of said flow passage forming a metering nip with said surface, a metering chamber in said flow passage immediately upstream of said metering mean in the direction of movement of said surface past said coater head, a shear developing passage, said shear developing passage having an outlet end for delivering coating into said metering chamber and a receiving end remote from said outlet end, a mixing passage opening into said metering chamber, said surface forming one wall of said mixing passage and said metering chamber, said rotating of said surface moving said surface relative to said coater head a direction from said mixing passage toward said metering means, an unobstructed space within said metering chamber, an expansion angle $\alpha$ of at least 25° and having its vertex at said metering nip define outer boundaries on two sides of said unobstructed space of said metering chamber, at least a portion of a rear wall of said metering chamber remote from said metering nip defining an end of said unobstructed space, said portion of said rear wall being spaced from said metering nip by a length r measured from said metering nip to said portion of said rear wall of between 40 and 60 mm, said portion including the area within said expansion angle a on said rear wall.

Preferably, said coater head further comprises a throttle adjacent to said opening of said mixing passage into said metering chamber, said throttle narrowing said mixing passage adjacent to said opening to throttle flow between said metering chamber and said mixing passage and being spaced from said nip by a second distance L of between 45 and 65 mm.

Preferably, said outlet end of said shear developing passage opens directly into said metering chamber through said rear wall.

Preferably, said outlet end is positioned on the side of said portion of said rear wall remote from said surface.

Preferably, said metering means comprises a metering rod and means pressing said metering rod toward said surface to form said nip.

BRIEF DESCRIPTION OF THE DRAWINGS

Further features, objects and advantages will be evident from the following detailed description of the preferred embodiments of the present invention taken in conjunction with the accompanying drawings in which.

DESCRIPTION OF THE PREFERRED EMBODIMENTS

Figure 1:
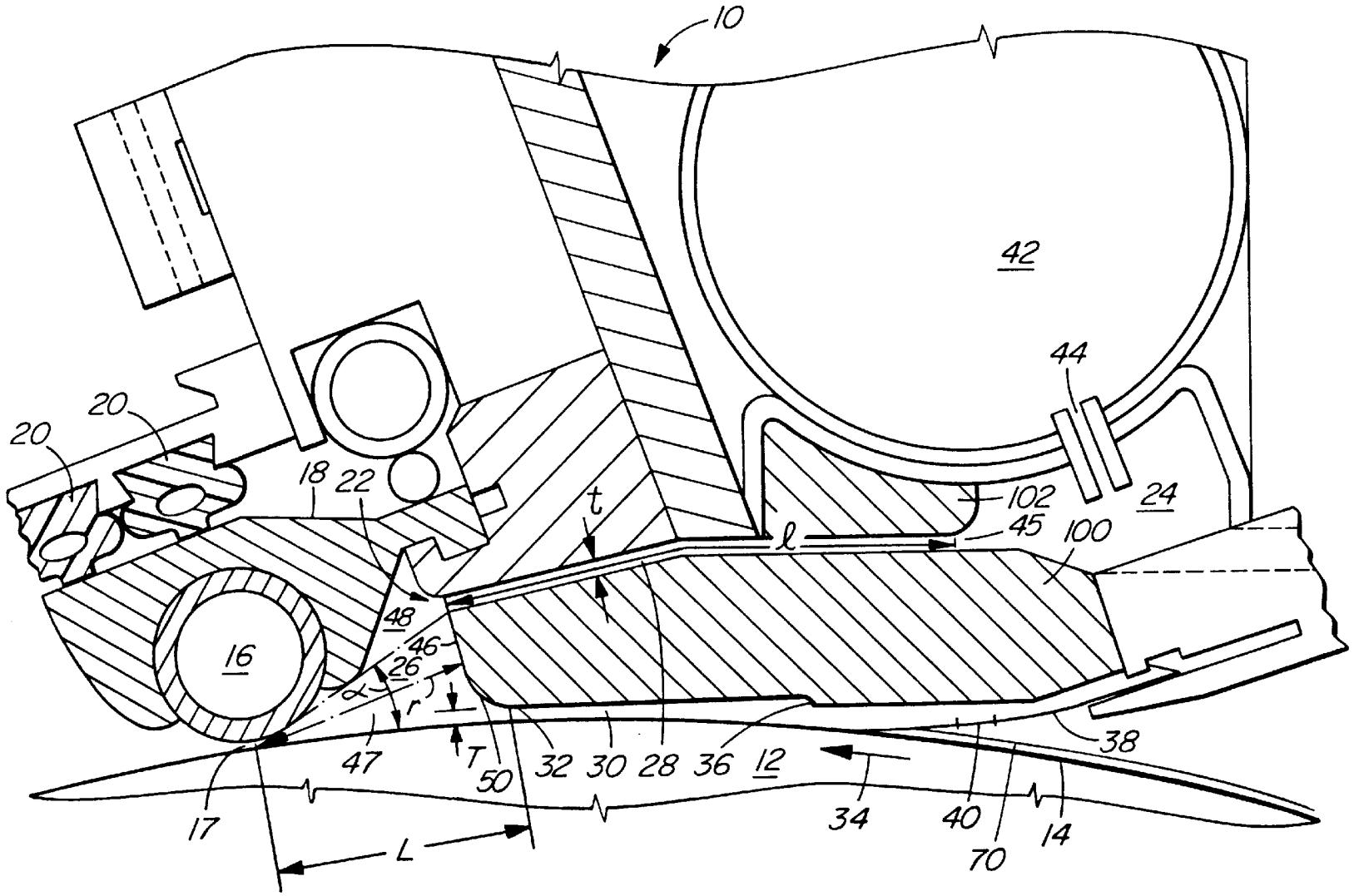
FIG. 1 is a section through a metering head incorporating the present invention.

As shown in FIG. 1, the coater head generally indicated at 10 applies coating to a application roll 12 having a surface 14 onto which the coating is applied for delivery into a application nip (not shown) of a size press where it is applied to a substrate and to be coated in the conventional manner.

The coater head 10 is provided at its outlet end with a metering device which in the illustrated invention is in the form of a metering rod 16 mounted on an arm 18 and biased toward the roll 12 via pneumatic tubes or the like 20 (in the illustrated arrangement, two such tubes have been shown). These tubes that are intended to receive air under pressure, i.e. provide pneumatic pressure on the arm 18 to force the metering rod 16 against the application roll 12 and form the metering nip 17.

A flow path generally indicated at 22 includes an expansion or a homogenization chamber 24 at its inlet end and a metering chamber 26 adjacent to the metering rod 16 at its outlet end. A shear developing passage 28 forms the portion of the flow path 22 that connects the homogenization chamber 24 to the metering chamber 26.

A mixing passage 30 formed adjacent to the surface 14 of the application roll 12 opens into the metering chamber 26 and is provided with a throttle 32 (restriction of the passage 30) adjacent to the opening of the passage 30 into the metering chamber 26. The prime purpose of the mixing passage 30 is to ensure better mixing of the coating fluid leaving the vortex in the mixing chamber 26 with the fresh coating fluid entering the system and to ensure there is no entrainment of air with the roll surface14. The shape of the mixing passage 30 gradually increases in width (spacing from the surface 14) in a direction upstream of the direction of movement of surface 14 as indicated by the arrow 34. In the illustrated arrangement the passage 30 is provided with a restriction as indicated at 36 adjacent to the free end of a sealing blade 38 which limits the rearward flow of coating fluid through the openings 40 in the doctor blade. This rearward flow must be maintained at least at a selected minimum to ensure there is no air entrainment into the mixing passage 30 with the recirculating flow as will be described in more detail below. The blade 38 is not essential to the invention and may be omitted with an appropriately designed mixing passage that prevent air entrainment into the metering chamber 26

An inlet header 42 delivers coating liquid into the head 10 and directs the coating liquid from the header 42 into the chamber 24 via passage 44.

The shear developing passage 28 is important to permit operation with relatively high solids content coating formulations (high viscosity coating formulations), thus, the length l measured from the inlet end 45 at the chamber 24 to the outlet end 48 emptying into the chamber 26 combined with the thickness t of the passage are designed in known manner to generate sufficient shear or resistance to flow of the coating formulation therethrough to significantly reduce its viscosity and thereby facilitate the application of low coat weights to the roll 12 as it leaves the metering nip 17 between the roll 12 and rod 16.

Applicant has found that the viscosity of a coating fluid having a solids content of at least about 58% required, a length 1 of at least 100 mm for a passage having a thickness t=3 mm to effectively reduce the viscosity by one order of magnitude for the specific formulation being used and this permitted reduction of the coat weight applied in the application nip (not shown) by about 25%. Obviously, the length l may be shorter if the thickness or height t is also reduced, i.e. l may be changed depending on the dimension t in known manner to accommodate different viscosity and different desired changes in viscosity. It will be apparent that there are limits to the solids contents of the coatings that may effectively be treated to reduce their viscosity for better performance.

It is also important that the remainder of the path 22 to the nip 17 not be so long (time of flow to the metering nip) or so dimensioned, that the improved rheology of the coating produced in the passage 28 is lost before the coating reaches the nip 17.

The metering chamber 26 must also be properly sized to maintain a stable vortex or the coating application will not be uniform. Applicant has found that the unobstructed space 47 defined on a pair of opposite sides by an expansion angle ot, i.e. the angle $\alpha$ from the nip 17 between the surface 14 and the adjacent surface of the arm 18 must be at least 25°. It is also important that the length of the unobstructed space 47 in the metering chamber 26 as measured from the nip 17 to the portion of rear wall 46 of the chamber 26 within the angle $\alpha$ as indicated by the radius r be at least 40 mm and not greater than 60 mm.

If the length r is too short the vortex formed in the chamber 26 becomes too restricted and generates instabilities that affect the ability of the metering nip to uniformly meter the amount of coating applied and similarly if the length r is too long control of the vortex is lost and instabilities that affect the metering are generated.

The space 48 above the vortex formed by the angle cc should not be excessive.

It is preferred that the outlet end of the passage at 28, i.e. the inlet into the chamber 26 extend through the rear wall 46 preferably into the space 48, i.e. on the side of the portion of the wall 46 within the angle a remote from the surface 14 although it may be directed into the chamber 26 at any point above the opening into the mixing passage 30.

The opening as indicated at 50 from the chamber 26 to the mixing passage 30 is provided with a throttle 32 having a throttle gap or height indicated at T which will normally be 1 to 3 mm. Thus gap T controls the flow between the mixing passage 30 and the metering chamber 26 as well as the pressure in the chamber 26 and thus must be appropriately set.

It will be noted that the throttle 32 is spaced from the nip 17 by length along the surface 14 indicated by the dimension L,. This dimension L in effect defines the size of the chamber 26 in a manner similar to the dimension r. However, L better defines the length along the surface 14 immediately upstream of the nip where unstable vortexes may form. This length L should not exceed 65 mm.

The length of the mixing passage 30 measured in the direction of the arrow 34 must be sufficient to prevent air entrainment with the return or recycled fluid 70 accompanying the surface 14 as it moves into and under the coater head 10. Generally, this mixing passage 30 will have a length of at least about 20 mm measured upstream from throttle 32. The width or thickness of the passage 30 measured perpendicular from the surface 14 must be set to prevent air entrainment (thus may differ if a blade 38 is used), and generally will be about 1 to 3 mm at the throttle 36 and will expand to about 6 mm at its upstream end (restriction 36 in the illustrated arrangement).

Figure 2:
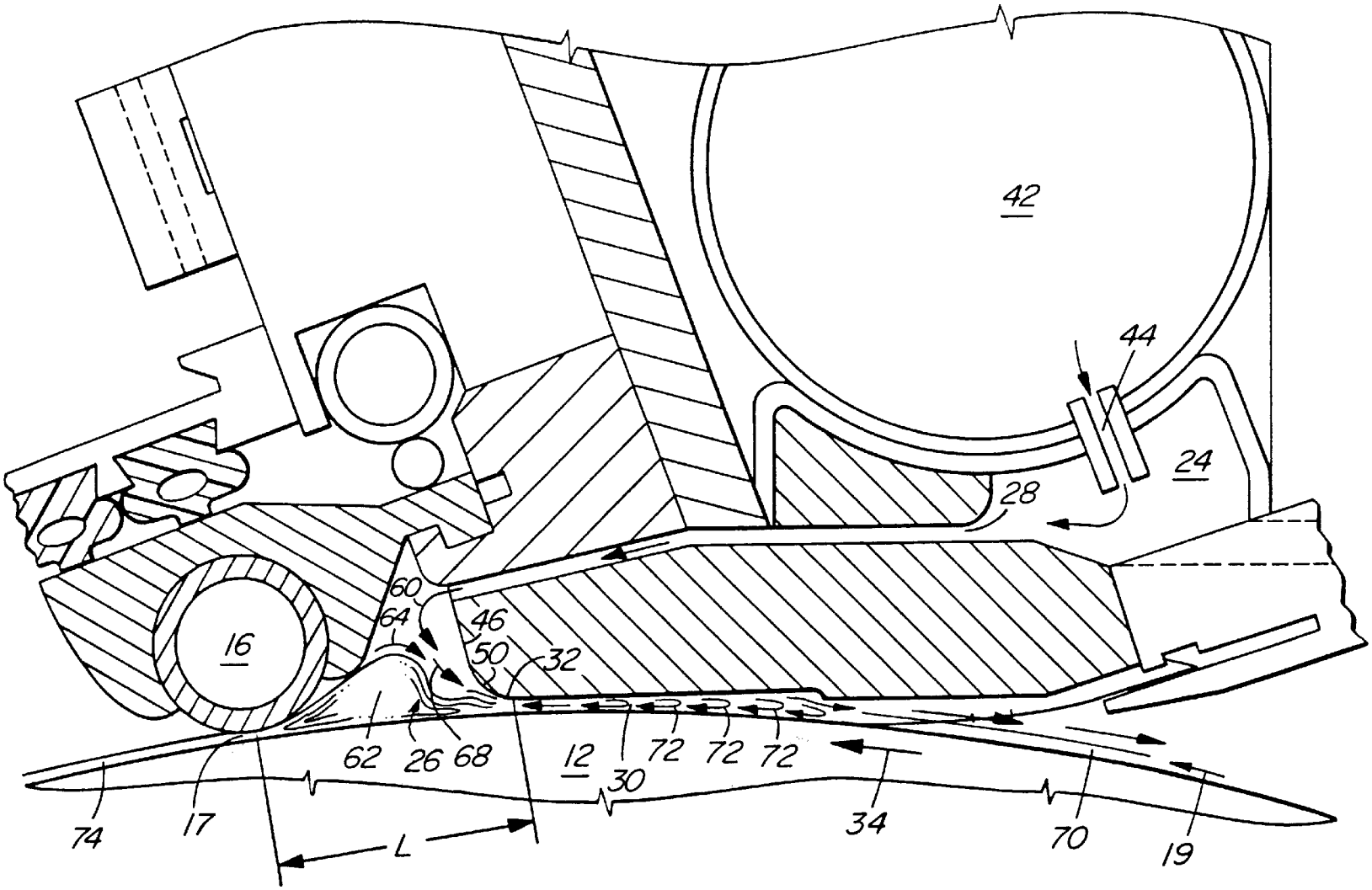
FIG. 2 is a view similar to FIG. 1 showing flow patterns within the head.

Turning to FIG. 2, it can be seen that the coating formulation passes from the header 42 passage 44 into the homogenizing chamber 24 and from that chamber into the passage 28 where shear is applied to reduce the viscosity of coating formulation as required. The coating fluid then enters the metering chamber 26 and is diverted to flow as indicated by the arrow 60 down along the rear face 46 of the chamber 26 and into the opening 50 between the mixing passage 30 and the metering chamber 26. This flow 60 is mixed to a limited degree and entrained with or entrains some of the flow from the stable vortex 62 to be described below as schematically represented by the arrow 64 to provide a combined flow 68 entering the opening 50.

This combined flow 68 passes through the throttle 32, i.e. between the throttle point 32 and the surface 14 of the roll 12 into the mixing passage 30 where the combined flow 68 is entrained by the in-coming recirculating flow generally indicated at 70 that travels with the surface 14. This flow 70 entrains fresh coating from the combined coating flow 68 and reverses its direction of flow as indicated by the arrow 72 to induce flow of the layer 70 plus the entrained fresh coating through the throttle 32 and into the chamber 26 moving in the direction of the arrow 34, i.e. direction of the surface 14 and carries this coating to the nip 17 where some of the coating traveling with the surface 14 passes through the nip 17 and forms the wet film layer 74 that is carried to the application nip (not shown) for application to the paper.

A stable vortex 62 is formed by the excess fluid delivered to the nip 17 and not forming part of the wet film 74. However, to ensure that a stable vortex or reasonably stable vortex is formed, it is important that the dimensions r, L and $\alpha$ be as above specified. If $\alpha$ is too small, the vortex will be unstable which will result in eddy currents in the coating material traveling with the surface 14 and thus, non-uniformity in the wet film 74. Similarly, if the length L is not sufficient, the stability of the vortex will be disrupted. On the other hand, if the length L is too long, unstable vortices will be developed at the interface of the stable vortex 62 and the surface of the material carried by the roll 12 or surface 14 and the mixing passage 30 to the nip 17 and these vortices will further disrupt the wet film 74 and in many cases may be detrimental to wet film uniformity. The length L must not be too long as it defines the time for generating eddies in the incoming coating flowing toward the nip 17.

EXAMPLE

Figure 3:
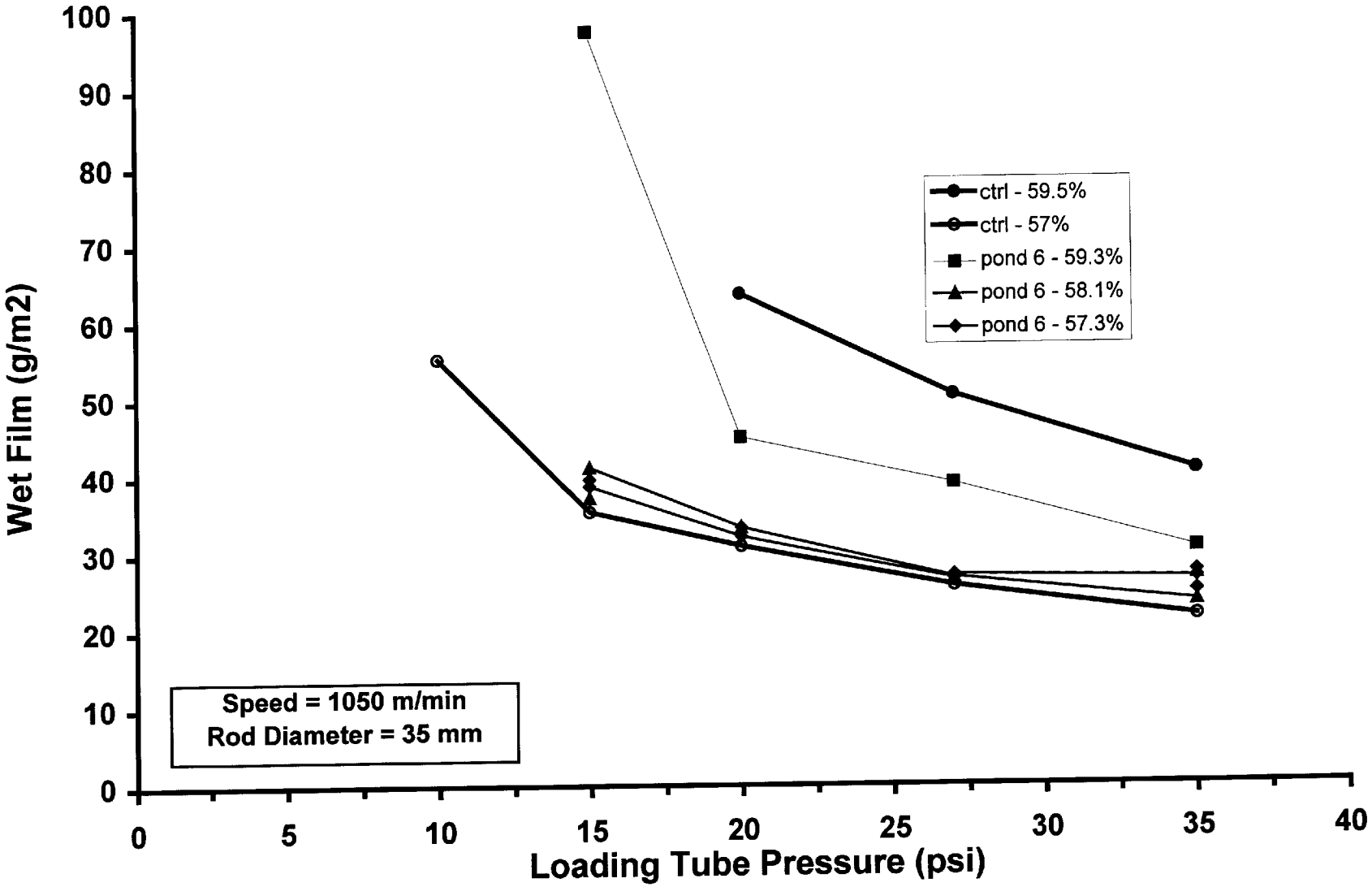
FIG. 3 is a plot of wet film weight leaving the coating applicator versus tube loading pressures (metering nip pressures) at different coating solids content.

In order to illustrate the effectiveness of the present invention, a specific model of the present invention was constructed and applied. In this device, the passage 28 had a thickness t of 3 mm and a length l of 11 cm. The radius r was 4.5 cm and the length L 5.5 cm. The passage 30 rearward of the throttle 32 to the tip of the blade 38, i.e. notch 34 was 6 cm and the angle a was about 25°. With this device and a flow rate of 80 ltr/min of coating fluid and a speed in the direction near 34 of 1050 m/min using a metering rod 16 having a diameter of 35 mm, the wet film weight in grams/$m^2$ of the surface area of the surface 14 was measured using different loading tube pressures in the tubes 20 and compared with a control. It can be seen from FIG. 3 that at high solids content of 59.3% (of the present invention) was able to be applied a significant lower film weight using the present invention than was obtainable by the control (the same device less the cross-hatched element indicated at 100 and 102 in FIG. 1). However, at low solids content, there appears to be minimal difference. The important feature intended to be obtained by the present invention is to permit the use of high solids content above 59% (lower solids content, for example, 58 or 57% significantly increase the cost of coating and generally do not develop the same coating appearance as the higher solids coating composition).

While Applicant has provided a blade 38 at the outlet (upstream) end of the mixing passage 30, the blade need not be provided but in such a case, a second throttle or a weir is preferably provided to slightly narrow the passage between the surface 14 and the coater head.

It will be apparent that the above system permits reduction of the pressure in the metering chamber which permits operation with softer roll covers on the size press rolls.

Having described the invention, modifications will be evident to those skilled in the art without departing from the scope of the invention as defined in the appended claims.

We claim:

1. A coater head for application of a coating to a receiving surface on a size press roll of a size press type coater, said roll rotating relative to said coater head to move said surface past said coater head, said coater head comprising a flow passage, a metering device at an outlet end of said flow passage forming a metering nip with said surface, a metering chamber in said flow passage immediately upstream of said metering device in the direction of movement of said surface past said coater head, a shear developing passage, said shear developing passage having an outlet end for delivering coating into said metering chamber and a receiving end remote from said outlet end, said shear developing passage having a length l from its receiving end to its outlet end and a thickness t coordinated to apply sufficient shear to said coating as it flows therethrough to significantly reduce the viscosity of said coating, a mixing passage opening into said metering chamber, said surface forming one wall of said mixing passage and of said metering chamber, said rotating of said surface moving said surface relative to said coater head in a direction from said mixing passage toward said metering device, said mixing passage being dimensioned to cause mixing of a fresh portion of said coating with a residual portion of said coating carried on said surface and to prevent air entrainment into said metering chamber, an unobstructed space within said metering chamber, said unobstructed space being dimensioned to permit formation of a stable vortex of coating in said unobstructed space, wherein outer boundaries on two sides of said unobstructed space of said metering chamber an expansion angle $\alpha$ of at least 25° with the vertex of said expansion angle a at said metering nip, at least a portion of a rear wall of said metering chamber remote from said metering nip defining an end of said unobstructed space, said portion of said rear wall being spaced from said metering nip by a length r measured from said metering nip to said portion of said rear wall of between 40 and 60 mm, said portion including the area within said expansion angle $\alpha$ on said rear wall.

2. A coater head as defined in claim 1 wherein said coater head further comprises a throttle adjacent to said opening of said mixing passage into said metering chamber, said throttle narrowing said mixing passage adjacent to said opening to throttle flow between said metering chamber and said mixing passage and being spaced from said nip by a second distance L of between 45 and 65 mm.

3. A coater head as defined in claim 2 wherein said metering device comprises a metering rod and means pressing said metering rod toward said surface to form said nip.

4. A coater head as defined in claim 2 wherein said metering device and said mixing passage formed the sole outlets for said coating from said metering chamber.

5. A coater head as defined in claim 2 wherein said outlet end of said shear developing passage opens directly into said metering chamber through said rear wall.

6. A coater head as defined in claim 5 wherein said metering device comprises a metering rod and means pressing said metering rod toward said surface to form said nip.

7. A coater head as defined in claim 5 wherein said metering device and said mixing passage formed the sole outlets for said coating from said metering chamber.

8. A coater head as defined in claim 5 wherein said outlet end is positioned on the side of said portion of said rear wall remote from said surface.

9. A coater head as defined in claim 8 wherein said metering device comprises a metering rod and means pressing said metering rod toward said surface to form said nip.

10. A coater head as defined in claim 8 wherein said metering device and said mixing passage formed the sole outlets for said coating from said metering chamber.

11. A coater head as defined in claim 1 wherein said outlet end of said shear developing passage opens directly into said metering chamber through said rear wall.

12. A coater head as defined in claim 11 wherein said metering device comprises a metering rod and means pressing said metering rod toward said surface to form said nip.

13. A coater head as defined in claim 11 wherein said metering device and said mixing passage formed the sole outlets for said coating from said metering chamber.

14. A coater head as defined in claim 11 wherein said outlet end is positioned on the side of said portion of said rear wall remote from said surface.

15. A coater head as defined in claim 14 wherein said metering device comprises a metering rod and means pressing said metering rod toward said surface to form said nip.

16. A coater head as defined in claim 14 wherein said metering device and said mixing passage formed the sole outlets for said coating from said metering chamber.

17. A coater head as defined in claim 1 wherein said metering device comprises a metering rod and means pressing said metering rod toward said surface to form said nip.

18. A coater head as defined in claim 17 wherein said metering device and said mixing passage formed the sole outlets for said coating from said metering chamber.

19. A coater head as defined in claim 1 wherein said metering device and said mixing passage formed the sole outlets for said coating from said metering chamber.

* * * * *